US006789458B2

(12) United States Patent
Schumacher et al.

(10) Patent No.: US 6,789,458 B2
(45) Date of Patent: Sep. 14, 2004

(54) SYSTEM FOR CONTROLLING HYDRAULIC ACTUATOR

(75) Inventors: Mark S. Schumacher, Minneapolis, MN (US); Terrance F. Krouth, Eden Prairie, MN (US); David E. Wiklund, Eden Prairie, MN (US); Richard J. Habegger, Wolcottville, IN (US); Richard R. Hineman, Gunterville, AL (US)

(73) Assignee: Rosemount Inc., Eden Prairie, MN (US)

( * ) Notice: Subject to any disclaimer, the term of this patent is extended or adjusted under 35 U.S.C. 154(b) by 0 days.

(21) Appl. No.: 10/317,311

(22) Filed: Dec. 12, 2002

(65) Prior Publication Data

US 2003/0079603 A1 May 1, 2003

Related U.S. Application Data

(63) Continuation of application No. 09/801,259, filed on Mar. 7, 2001, now abandoned.

(60) Provisional application No. 60/218,329, filed on Jul. 14, 2000, and provisional application No. 60/187,849, filed on Mar. 8, 2000.

(51) Int. Cl.[7] ..... F15B 9/03

(52) U.S. Cl. ..... 91/363 R

(58) Field of Search ..... 91/363 R

(56) References Cited

U.S. PATENT DOCUMENTS

| | | | | |
|---|---|---|---|---|
| 1,480,661 | A | 1/1924 | Brown | |
| 1,698,314 | A | 1/1929 | Mapelsden | |
| 2,943,640 | A | 7/1960 | James | 137/594 |
| 3,160,836 | A | 12/1964 | Farley | 336/30 |
| 3,388,597 | A | 6/1968 | Bargen et al. | 73/398 |
| 3,430,489 | A | 3/1969 | Pfrehm | 73/231 |

(List continued on next page.)

FOREIGN PATENT DOCUMENTS

| | | |
|---|---|---|
| DE | 31 16333 A1 | 4/1981 |
| DE | 3244668 | 6/1984 |

(List continued on next page.)

OTHER PUBLICATIONS

U.S. patent application No. 09/521,132, entitled "Piston Position Measuring Device," Filed Mar. 8, 2000.

U.S. Provisional Application No. 60/218,329, entitled "Hydraulic Valve Body with Differential Pressure Flow Measurement," filed Jul. 14, 2000.

(List continued on next page.)

*Primary Examiner*—Edward K. Look
*Assistant Examiner*—Igor Kershteyn
(74) *Attorney, Agent, or Firm*—Westman, Champlin & Kelly

(57) ABSTRACT

A system and method for controlling at least one hydraulic actuator of a hydraulic system includes a flow rate measurement of a hydraulic fluid flow traveling into and out of a cavity of the hydraulic actuator. The flow rate is used to calculate piston information corresponding to a position, velocity, acceleration, and/or direction of movement of a piston of the hydraulic actuator. The piston information can then be provided to an output device to aid in the control of the hydraulic actuator. Alternatively, the piston information can be compared to a reference signal relating to a desired position, velocity, acceleration, and/or direction of movement of the piston to produce a control signal, which can be used to adjust the hydraulic fluid flow and provide the desired actuation of the piston.

20 Claims, 3 Drawing Sheets

U.S. PATENT DOCUMENTS 3,494,190 A 2/1970 Schwartzman ..... 73/228
3,561,831 A 2/1971 Alibert et al. ..... 310/8.7
3,657,925 A 4/1972 Gross ..... 73/239
3,678,754 A 7/1972 Amir et al. ..... 73/419
3,727,520 A * 4/1973 McKown et al. ..... 91/433
3,817,283 A 6/1974 Hewson
3,958,492 A 5/1976 Curless ..... 91/363 R
4,031,813 A * 6/1977 Walters et al. ..... 91/433
4,100,798 A 7/1978 Nilsson et al. ..... 73/194 E
4,126,047 A 11/1978 Sethares et al. ..... 73/505
4,193,420 A 3/1980 Hewson ..... 137/356
4,205,592 A * 6/1980 Haussler ..... 91/433
4,249,164 A 2/1981 Tivy ..... 340/870.3
4,275,793 A * 6/1981 Schivley et al. ..... 91/1
4,281,584 A 8/1981 Onken et al. ..... 91/1
4,304,136 A 12/1981 McCabe et al. ..... 73/861.54
4,319,492 A 3/1982 Hewson et al. ..... 73/756
4,381,699 A 5/1983 Haussler ..... 91/433
4,424,716 A 1/1984 Boehringer et al. ..... 73/861.56
4,436,348 A 3/1984 Farr ..... 303/115
4,466,290 A 8/1984 Frick ..... 73/756
4,520,660 A 6/1985 Hitchcock ..... 73/120
4,539,967 A 9/1985 Nakajima et al. ..... 123/585
4,543,649 A 9/1985 Head et al. ..... 367/96
4,545,406 A 10/1985 King ..... 137/553
4,557,296 A 12/1985 Byrne ..... 138/44
4,584,472 A 4/1986 Wiblin et al. ..... 250/237 G
4,585,021 A 4/1986 Belknap ..... 137/100
4,588,953 A 5/1986 Krage ..... 324/58.5 C
4,627,196 A 12/1986 Veale ..... 51/281
4,631,478 A 12/1986 Knetsch et al. ..... 324/207
4,671,166 A 6/1987 Glaze et al. ..... 91/361
4,689,553 A 8/1987 Haddox ..... 324/58.5 C
4,737,705 A 4/1988 Bitar et al. ..... 324/58.5 C
4,742,794 A 5/1988 Hagstrom ..... 114/286
4,744,218 A 5/1988 Edwards et al. ..... 60/368
4,745,810 A 5/1988 Pierce et al. ..... 73/706
4,749,936 A 6/1988 Taplin ..... 324/58.5 B
4,751,501 A 6/1988 Gut ..... 340/607
4,757,745 A 7/1988 Taplin ..... 91/361
4,774,465 A 9/1988 Nilius ..... 324/208
4,841,776 A 6/1989 Kawachi et al. ..... 73/706
4,866,269 A 9/1989 Wlodarczyk et al. ..... 250/231
4,901,628 A 2/1990 Krage ..... 92/5 R
4,932,269 A 6/1990 Cammarata, III et al. ..... 73/861.61
4,938,054 A 7/1990 Dye et al. ..... 73/3
4,961,055 A 10/1990 Habib et al. ..... 324/662
4,987,823 A 1/1991 Taplin et al. ..... 91/361
5,000,650 A 3/1991 Brewer et al. ..... 414/699
5,031,506 A 7/1991 Baisch et al. ..... 91/363 R
5,036,711 A 8/1991 Good ..... 73/861.66
5,072,198 A 12/1991 Taplin et al. ..... 333/33
5,085,250 A 2/1992 Kendrick ..... 138/44
5,104,144 A 4/1992 Bethell ..... 280/707
5,150,049 A 9/1992 Schuetz ..... 324/207.12
5,150,060 A 9/1992 Bitar ..... 324/635
5,182,979 A 2/1993 Morgan ..... 92/5 R
5,182,980 A 2/1993 Greer ..... 92/5 R
5,218,820 A 6/1993 Sepehri et al. ..... 60/463
5,218,895 A 6/1993 Lukich et al. ..... 91/361
5,233,293 A 8/1993 Huang et al. ..... 324/207.15
5,241,278 A 8/1993 Bitar ..... 324/635
5,247,172 A 9/1993 Riemer ..... 250/227.21
5,260,665 A 11/1993 Goldberg et al. ..... 324/636
5,274,271 A 12/1993 McEwan ..... 307/108
5,313,871 A 5/1994 Kaneko et al. ..... 91/361
5,325,063 A 6/1994 Morgan ..... 324/636
5,332,938 A 7/1994 McEwan ..... 307/572
5,345,471 A 9/1994 McEwan ..... 375/1
5,361,070 A 11/1994 McEwan ..... 342/21
5,365,795 A 11/1994 Brower, Jr. ..... 73/861.65
5,422,607 A 6/1995 McEwan ..... 333/20
5,424,941 A 6/1995 Bolt et al. ..... 364/148
5,438,261 A 8/1995 Codina et al. ..... 324/207.16
5,438,274 A 8/1995 Bitar et al. ..... 324/636
5,455,769 A 10/1995 Panoushek et al. .... 364/424.07
5,457,394 A 10/1995 McEwan ..... 324/642
5,457,960 A 10/1995 Morishita ..... 91/361
5,461,368 A 10/1995 Comer ..... 340/607
5,465,094 A 11/1995 McEwan ..... 342/28
5,469,749 A 11/1995 Shimada et al. ..... 73/861.47
5,471,147 A 11/1995 Allen et al. ..... 324/635
5,471,162 A 11/1995 McEwan ..... 327/92
5,479,120 A 12/1995 McEwan ..... 327/91
5,491,422 A 2/1996 Bitar et al. ..... 324/636
5,510,800 A 4/1996 McEwan ..... 342/387
5,512,834 A 4/1996 McEwan ..... 324/642
5,517,198 A 5/1996 McEwan ..... 342/89
5,519,342 A 5/1996 McEwan ..... 327/94
5,519,400 A 5/1996 McEwan ..... 342/28
5,521,600 A 5/1996 McEwan ..... 342/27
5,523,760 A 6/1996 McEwan ..... 342/89
5,535,587 A * 7/1996 Tanaka et al. ..... 60/427
5,536,536 A 7/1996 Kelley ..... 427/386
5,540,137 A 7/1996 Lark et al. ..... 92/5 R
5,563,605 A 10/1996 McEwan ..... 342/202
5,573,012 A 11/1996 McEwan ..... 128/782
5,576,498 A 11/1996 Shambayati ..... 73/861.52
5,576,627 A 11/1996 McEwan ..... 324/639
5,581,256 A 12/1996 McEwan ..... 342/37
5,587,536 A 12/1996 Rasmussen ..... 73/744
5,589,838 A 12/1996 McEwan ..... 342/387
5,602,372 A 2/1997 Strelow ..... 200/81.9 R
5,609,059 A 3/1997 McEwan ..... 73/290 R
5,617,034 A 4/1997 Lark et al. ..... 324/635
5,661,277 A 8/1997 Graham, II ..... 200/81.9 R
5,710,514 A 1/1998 Crayton et al. ..... 324/635
5,773,726 A 6/1998 Mahoney et al. ..... 73/861.65
5,817,950 A 10/1998 Wiklund et al. ..... 73/861.66
5,861,546 A 1/1999 Sagi et al. ..... 73/40.5
5,879,544 A 3/1999 Cassidy ..... 210/90
5,901,633 A 5/1999 Chan et al. ..... 92/5 R
5,977,778 A 11/1999 Chan et al. ..... 324/635
6,142,059 A 11/2000 Chan et al. ..... 92/5 R
6,269,641 B1 * 8/2001 Dean ..... 91/1
6,286,412 B1 * 9/2001 Manring et al. ..... 91/433

FOREIGN PATENT DOCUMENTS

DE 4220333 12/1993
DE G 94 17 204.8 10/1994
DE 0 686 831 A2 12/1995
DE 29616034 2/1997
EP 0154531 9/1985
EP 0 266 606 A2 10/1987
EP 0309643 4/1989
EP 0331772 9/1989
EP 0 887 626 A1 6/1998
FR 2485724 12/1981
GB 1080852 8/1967
GB 1467957 3/1977
GB 2011997 7/1979
GB 2155635 9/1985
GB 2 172 995 A 10/1986
GB 2259147 3/1993
GB 2 301 676 12/1996
JP 0168106 10/1982
JP 57-198823 12/1982
JP 6160605 7/1986
JP 63070121 3/1988
JP 01207634 11/1989

| | | |
|---|---|---|
| JP | 04-225126 | 8/1992 |
| JP | 0168107 | 10/1992 |
| JP | 06-213694 | 1/1994 |
| WO | WO 96/24028 | 8/1996 |
| WO | WO 98/23867 | 6/1998 |

OTHER PUBLICATIONS

U.S. patent application No. 90/521,537, entitled "Bi–Directional Differential Pressure Flow Sensor," filed Mar. 8, 2000.
U.S. Provisional Application No. 60/187,849, entitled "System for Controlling Multiple Hydraulic Cylinders," filed Mar. 8, 2000.
U.S. patent application Ser. No. 09/394,728, Kleven, filed Sep. 13, 1999.
U.S. patent application Ser. No. 09/395,688, Kleven, filed Sep. 13, 1999.
Process Instrument Engineers Handbook, Revised Edition, Chapters 2.10, 2.11, and 2.12, pp. 87–110 (1982).
Model 8800A Vortex Flowmeter, Key Differentiators (undated).
Model 8800 Smart Vortex Flowmeter, Fisher–Rosemount, Managing the Process Better, pp. 2–19, (1994).
Model 8800A Smart Vortex Flowmeter, Fisher–Rosemount, Managing the Process Better, pp. 2–21 (1997).
On–Line Catalog Level and Flow Instrumentation—Flow Gauges, Industrial Process Measurement, Inc., re: RCM Industries, Inc. products, 6 pages.
Kobold, re: RCM Industries, Inc. products, pp. 13–18.
Office Communication from the USPTO for Application No. 09/521,132, filing date Mar. 8, 2000. Date Mailed May 1, 2003.
Office Communication from the USPTO for Application No. 09/521,132, filing date Mar. 8, 2000. Date Mailed Aug. 27, 2002.
Office Communication from the USPTO for Application No. 09/521,132, filing date Mar. 8, 2000. Date Mailed Jun. 12, 2002.
Office Communication from the USPTO for Application No. 09/521,132, filing date Mar. 8, 2000. Date Mailed Aug. 20, 2001.
Office Communication from the USPTO for Application No. 09/521,132, filing date Mar. 8, 2000. Date Mailed Feb. 11, 2002.
Office Communication from the USPTO for Application No. 09/801,259, filing date Mar. 7, 2001. Date Mailed Mar. 28, 2003.
Office Communication from the USPTO for Application No. 09/801,259, filing date Mar. 7, 2001. Date Mailed Jul. 19, 2002.
Office Communication from the USPTO for Application No. 09/801,266, filing date Mar. 7, 2001. Date Mailed Feb. 26, 2003.
Office Communication from the USPTO for Application No. 09/801,266, filing date Mar. 7, 2001. Date Mailed Jul. 9, 2002.
Office Communication from the USPTO for Application No. 09/801,266, filing date Mar. 7, 2001. Date Mailed Feb. 11, 2002.
Office Communication for Application No. 10/317,981 filed Dec. 12, 2000. Date mailed Mar. 3, 2004.
U.S. patent application Ser. No. 09/395,688, Kleven, filed Sep. 13, 1999.
U.S. patent application Ser. No. 09/394,728, Kleven, filed Sep. 13, 1999.
Nishimoto T. et al., article entitled "Buried Piezoresistive sensors by means of MeV ion implantation", *Sensors and Actuators*, May 1994, vol. A43, No. 1/3, pp. 249–253.
Process Instrument Engineers Handbook, Revised Edition, Chapters 2.10, 2.11, and 2.12, pp. 87–110 (1982).
Model 8800A Vortex Flowmeter, Key Differentiators (undated).
Model 1195 Integral Orifice Assembly, Rosemount Catalog pp. Flow–125–Flow 137 (Published 1995).
Model 8800 Smart Vortex Flowmeter, Fisher–Rosemount, Managing the Process Better, pp. 2–19, (1994).
Model 8800A Smart Vortex Flowmeter, Fisher–Rosemount, Managing the Process Better, pp. 2–21 (1997).
On–Line Catalog Level and Flow Instrumentation—Flow Gauges, Industrial Process Measurement, Inc., re: RCM Industries, Inc. products, 6 pages.
Kobold, re: RCM Industries, Inc. products, pp. 13–18.
"A Physicist's Desk Reference", *American Institute of Physics*, New York, 1992, p. 201.
"Handbook of Chemistry and Physics", CRC Press, Ohio, 1975, p. E–223.
"The Electrical Engineering Handbook", Editor–in–Chief, R. Dorf, CRC Press, 1997, pp. 811–812.
Brochure: Technik, "Absolute Position Measurement Using Conducive Plastic Potentiometers".
Brochure: Penny + Giles "Technology Leaders in Displacement Monitoring & Manual Control".
Brochure: DC Hydrostar, "Position Transducer".
"An LVDT Primer", *Sensors*, Jun. 1996, pp. 27–30.
"Understanding Magnetostrictive LDTs", W.D. Peterson, *Hydraulics & Pneumatics*, Feb. 1993, pp. 32–34.
Brochure: Penny + Giles Product Data, "Cylinder Transducer Model HLP100".
Magazine: "Not Just a Blip on the Screen", *Business Week*, Feb. 19, 1996, pp. 64–65.
International Search Report from International Application No. PCT/US 02/15311, filed May 15, 2002. Date of report Aug. 5, 2002.
U.S. patent application No. 09/521,132, entitled "Piston Position Measuring Device," Filed Mar. 8, 2000.
U.S. Provisional Application No. 60/218,329, entitled "Hydraulic Valve Body with Differential Pressure Flow Measurement," filed Jul. 14, 2000.
U.S. patent application No. 90/521,537, entitled "Bi–Directional Differential Pressure Flow Sensor," filed Mar. 8, 2000.
U.S. Provisional Application No. 60/187,849, entitled "System for Controlling Multiple Hydraulic Cylinders," filed Mar. 8, 2000.

* cited by examiner

SYSTEM FOR CONTROLLING HYDRAULIC ACTUATOR

CROSS-REFERENCE TO RELATED APPLICATION

This is a continuation of U.S. patent application Ser. No. 09/801,259, filed Mar. 7, 2001 now abandoned, and entitled "SYSTEM FOR CONTROLLING HYDRAULIC ACTUATOR," and claims the benefit of U.S. patent application Ser. No. 09/521,132, entitled "PISTON POSITION MEASURING DEVICE," filed Mar. 8, 2000, and U.S. Provisional Application No. 60/218,329, entitled "HYDRAULIC VALVE BODY WITH DIFFERENTIAL PRESSURE FLOW MEASUREMENT," filed Jul. 14, 2000. In addition, the present invention claims the benefit of U.S. patent application Ser. No. 09/521,537, entitled "BI-DIRECTIONAL DIFFERENTIAL PRESSURE FLOW SENSOR," filed Mar. 8, 2000, and U.S. Provisional Application No. 60/187,849, entitled "SYSTEM FOR CONTROLLING MULTIPLE HYDRAULIC CYLINDERS," filed Mar. 8, 2000.

BACKGROUND OF THE INVENTION

The present invention relates to hydraulic systems of the type used to actuate machinery. More specifically, the present invention relates to controlling such systems through measurement of position, velocity, acceleration, and/or direction of movement of hydraulic actuator pistons of hydraulic actuators.

Hydraulic systems are used in a wide variety of industries ranging from road construction to processing plants. These systems are generally formed of hydraulic control valves and hydraulic actuators. Typical hydraulic actuators include a hydraulic cylinder containing a piston. A rod is attached to the piston at one end and to an object, which is to be manipulated by the hydraulic actuator, at the other end. The hydraulic system controls at least one hydraulic control valve to direct a hydraulic fluid flow into and out of at least one cavity of a hydraulic actuator that is defined by the piston and the hydraulic cylinder. The hydraulic fluid flow causes a change in the position of the piston within the hydraulic cylinder and produces the desired actuation of the object.

The control of the hydraulic actuators is often performed by an operator who visually inspects the position of the hydraulic actuators. Such a physical inspection is relatively crude and prone to a great deal of inaccuracy. For many applications, it would be useful to know the position, velocity and/or acceleration of the piston. By these variables, a control system could be established to more precisely control the location or orientation, velocity and acceleration of the objects being actuated by the hydraulic actuators. For example, a blade of a road grading machine could be repeatedly positioned as desired resulting in more precise grading.

There is a need for improved methods and devices which are capable of achieving accurate, repeatable, and reliable hydraulic actuator piston position measurement and control.

SUMMARY OF THE INVENTION

The present invention is directed to a hydraulic control system for controlling at least one hydraulic actuator. The hydraulic control system includes a fluid flow sensor, a controller, and a communication link. The flow sensor is positioned in line with a hydraulic fluid flow and is adapted to measure a flow rate of the hydraulic fluid flow traveling into and out of a cavity of the hydraulic actuator. The flow sensor includes a sensor signal that is related to a position, velocity, acceleration, and/or a direction of movement of a piston contained in a hydraulic cylinder of the hydraulic actuator. A hydraulic control valve controls the hydraulic fluid flow traveling into the cavity, the volume of which is directly related to the position of the piston. The controller is adapted to receive the sensor signal from the flow sensor through the communication link.

In one aspect of the invention, the controller provides a piston information output relating to various types of piston information. The piston information generally corresponds to the position, velocity, acceleration, and/or the direction of movement of the piston. The piston information output can be provided to a human-machine interface to aid in the control of the piston and, thus, the object being actuated by the actuator.

In another aspect of the present invention, the controller produces a control signal based upon a comparison of the sensor signal to a reference signal. The reference signal generally relates to a desired position, velocity, acceleration, and/or direction of movement of the piston. The control signal is used to control the hydraulic fluid flow such that the piston is adjusted toward the desired position, velocity, acceleration, and/or direction of movement.

The present invention is also directed toward a method of controlling at least one piston of a hydraulic actuator. Here, a flow rate of a hydraulic fluid flow traveling into and out of a cavity of the hydraulic actuator is measured. Piston information relating to at least one of a position, a velocity, an acceleration, and a direction of movement of the piston is then calculated based upon the measured flow rate. Next, a reference signal is provided, which relates to at least one of a desired position, velocity, acceleration, and/or a direction of movement of the piston. Finally, the hydraulic fluid flow is adjusted based upon a comparison between the piston information and the reference signal. In this manner, the piston, whose movement is directly related to the hydraulic fluid flow, can be adjusted toward the desired position, velocity, acceleration, and/or direction of movement that is desired.

DETAILED DESCRIPTION OF THE PREFERRED EMBODIMENTS

Figure 1:
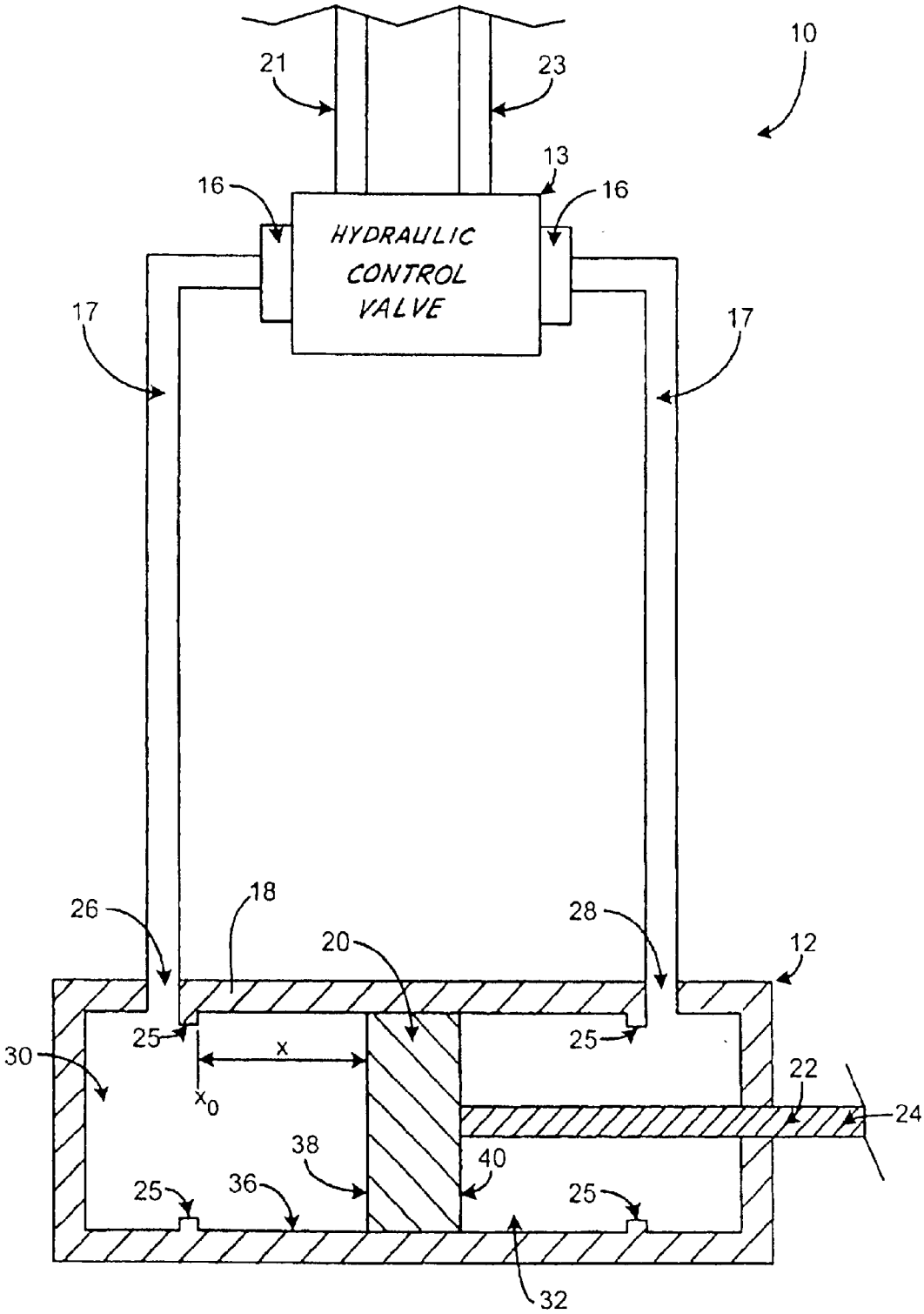
Fig. 1 Prior Art
FIG. 1 is a simplified diagram of an example of a hydraulic system, in accordance with the prior art, to which the present invention can be applied.

The present invention provides a method and system for controlling hydraulic actuators that are used in a hydraulic system to actuate components of a machine. FIG. 1 shows a simplified diagram of an example of a hydraulic system 10, with which embodiments of the present invention can be used. Hydraulic system 10 generally includes hydraulic actuator 12, hydraulic control valve 13, and high and low pressurized sources of provided through hydraulic lines 21 and 23. Hydraulic control valve 13 is generally adapted to control a flow of hydraulic fluid into and out of cavities of hydraulic actuator 12, which are fluidically coupled to ports 16 through fluid flow conduit 17. Alternatively, hydraulic control valve 13 could be configured to control hydraulic fluid flows into and out of multiple hydraulic actuators 12. Hydraulic control valve 13 can be, for example, a spool valve, or any other type of valve that is suitable for use in a hydraulic system.

The depicted hydraulic actuator 12 is intended to be one example of a hydraulic actuator, with which embodiments of the present invention may be used. Hydraulic actuator 12 generally includes hydraulic cylinder 18, piston 20, and rod 22. Piston 20 is attached to rod 22 and is slidably contained within hydraulic cylinder 18. Rod 22 is further attached to an object or component (not shown) of a machine at end 24 for actuation by hydraulic actuator 12. Piston stops 25 can be used to limit the range of motion of piston 20 within hydraulic cylinder 18. Hydraulic actuator 12 also includes first and second ports 26 and 28, through which a hydraulic fluid flow travels into and out of first and second cavities 30 and 32, respectively, through fluid flow conduit 17. First cavity 30 is defined by interior wall 36 of hydraulic cylinder 18 and surface 38 of piston 20. Second cavity 32 is defined by interior wall 36 of hydraulic cylinder 18 and surface 40 of piston 20.

First and second cavities 30 and 32 of hydraulic actuator 12 are completely filled with a substantially incompressible hydraulic fluid. As a result, the position of piston 20, relative to hydraulic cylinder 18, is directly related to the volume of either first cavity 30 or second cavity 32 and, thus, the volume of hydraulic fluid contained in first cavity 30 or second cavity 32. In operation, as pressurized hydraulic fluid is forced into first cavity 30, piston 20 is forced to slide to the right thereby decreasing the volume of second cavity 32 and causing hydraulic fluid to flow out of second cavity 32 though second port 28. Similarly, as pressurized hydraulic fluid is pumped into second cavity 32, piston 20 is forced to slide to the left thereby decreasing the volume of first cavity 30 and causing hydraulic fluid to flow out of first cavity 30 through first port 26. Those skilled in the art will understand that the present invention can be used with many different types of hydraulic actuators 12 having configurations that differ from the provided example and yet have at least a first cavity whose volume is directly related to the position of piston 20.

Figure 2:
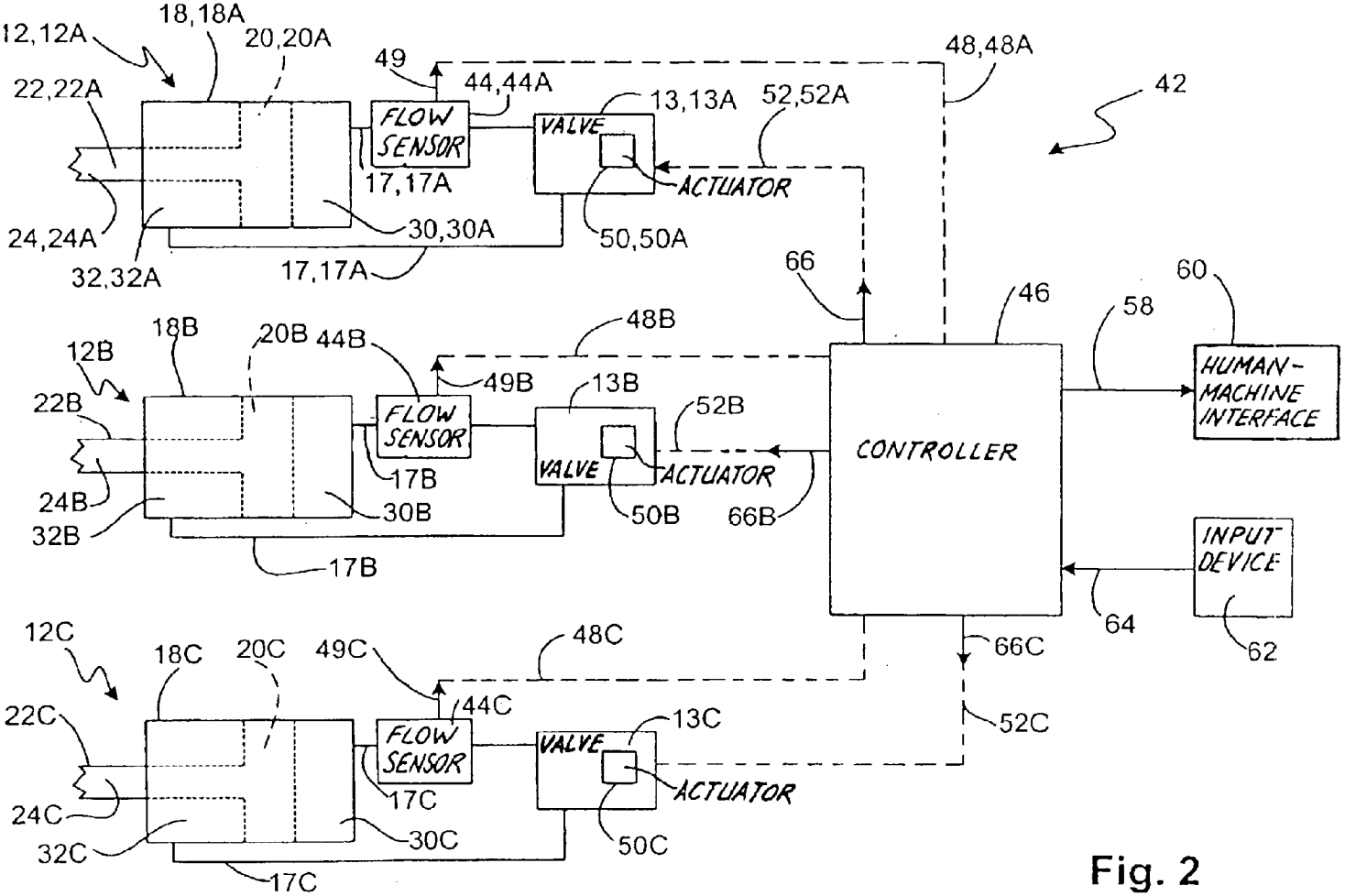
FIG. 2 is a simplified diagram of a hydraulic control system in accordance with an embodiment of the invention.

FIG. 2 shows a hydraulic control system 42, in accordance with the present invention, for controlling the actuation of at least one hydraulic actuator 12. Hydraulic control system 42 generally includes multiple hydraulic actuators 12, shown as hydraulic actuators 12A, 12B and 12C. Although only three hydraulic actuators 12A–C are shown, it should be understood that hydraulic actuators 12 can be added to or subtracted from the depicted hydraulic control system 42 as desired. Each of the sample hydraulic actuators 12A–C contain the same or similar components as hydraulic actuator 12 (FIG. 1), which are designated with the corresponding letter A, B or C, respectively. To simplify the discussion of hydraulic control system 42, the invention will be described with reference to a single hydraulic actuator 12, although the description can be applied to hydraulic actuators 12A–C by inserting the corresponding letter designations.

Hydraulic control system 42 generally includes at least one fluid flow sensor 44, a controller 46, and a communication link 48, through which information can be communicated between flow sensor 44 and controller 46. In one embodiment of the invention, fluid flow sensor 44 is adapted to produce a sensor signal relating to a flow rate $Q_{V1}$ of the hydraulic fluid flow traveling into and out of first cavity 30 of hydraulic actuator 12. The sensor signal can be used to calculate piston information relating to the position, velocity, acceleration and/or direction of movement of piston 20 relative to hydraulic cylinder 18.

Referring again to FIG. 1, the methods used to calculate the piston information based upon a measured flow rate $Q_{V1}$ will be discussed. A position x of piston 20 is directly related to the volume $V_1$ of hydraulic fluid contained in first cavity 30. This relationship is shown in the following equation:

$$x = \frac{V_1 - V_0}{A_1} \qquad \text{Eq. 1}$$

where $A_1$ is the cross-sectional area of first cavity 30 and $V_0$ is the volume of first cavity 30 when piston 20 is in reference position ($x_0$) from which the position x is measured.

As the hydraulic fluid is pumped into or out of first cavity 30, the position x of piston 20 will change. For a given reference or initial position $x_0$ of piston 20, a new position x can be determined by calculating the change in volume $\Delta V_1$ of first cavity 30 over a period of time $t_0$ to $t_1$ in accordance with the following equations:

$$\Delta V_1 = \int_{t0}^{t1} Q_{v1} \qquad \text{Eq. 2}$$

$$x = x_0 + \frac{\Delta V_1}{A_1} = x_0 + \frac{1}{A_1}\int_{t0}^{t1} Q_{v1} \qquad \text{Eq. 3}$$

where $Q_{v1}$ is the volumetric flow rate of the hydraulic fluid flow into or out of first cavity 30. Although, the reference position $x_0$ for the above example is shown as being set at the left most stops 25, other reference positions are possible as well. As a result, the position x of piston 20 can be determined using the flow rate $Q_{v1}$, which can be measured using flow sensor 44 (FIG. 2).

The velocity at which the position x of piston 20 changes is directly related to the volumetric flow rate $Q_{v1}$ of the hydraulic fluid flow into or out of first cavity 30. The velocity $\upsilon$ of piston 20 can be calculated by taking the derivative of Eq. 3, which is shown in the following equation:

$$v = \frac{dx}{dt} = \frac{Q_{v1}}{A_1} \qquad \text{Eq. 4}$$

The acceleration of piston 20 is directly related to the rate of change of the flow rate $Q_{v1}$, as shown in Eq. 5 below. Accordingly, by measuring the flow rate $Q_{v1}$ flowing into and out of first cavity 30, the position, velocity, and acceleration of piston 20 can be calculated.

$$a = \frac{dv}{dt} = \frac{d}{dt}\left(\frac{dx}{dt}\right) = \frac{1}{A_1}\left(\frac{dQ_{v1}}{dt}\right) \qquad \text{Eq. 5}$$

Finally, the direction of movement of piston 20 can be determined by the direction in which the hydraulic fluid flow is traveling. Here, a positive flow rate $Q_{V1}$ can be indicative of hydraulic fluid traveling into first cavity 30 thereby causing piston 20 to move to the right (FIG. 1) and a negative flow rate $Q_{V1}$ can be indicative of hydraulic fluid traveling out of first cavity 30 thereby causing piston 20 to move to the left.

As a result, by measuring of the flow rate $Q_{V1}$ of the hydraulic fluid flow traveling into and out of first cavity 30, piston information corresponding to the position, velocity, acceleration, and/or direction of movement of piston 20 of hydraulic actuator 12 can be determined. This piston information can provided to a user or additional processing electronics to assist in the control of an object being actuated by piston 20. Furthermore, the piston information can be used to control the position, velocity, acceleration, and/or direction of movement of piston 20 based upon a comparison to a desired position, velocity, acceleration, and/or direction of movement indicated by a reference signal.

In one preferred embodiment, flow sensor 44 is a differential pressure flow sensor. Here, flow sensor 44 is adapted to measure a pressure drop across a discontinuity placed in the hydraulic fluid flow and produce the sensor signal which relates to the pressure drop. The measured differential pressure can be used to calculate the flow rate $Q_{V1}$ of the hydraulic fluid flow using known methods. Flow sensor 44 can include a bi-directional flow restriction member that produces the desired discontinuity in the hydraulic fluid flow and allows flow sensor 44 to calculate flow rates $Q_{V1}$ of the hydraulic fluid flow flowing into and out of first cavity 30. One such suitable differential pressure flow sensor is described in U.S. patent application Ser. No. 09/521,537, entitled "BI-DIRECTIONAL DIFFERENTIAL PRESSURE FLOW SENSOR," and assigned to the assignee of the present invention.

The sensor signal indicated by arrow 49, can be provided to controller 46 over communication link 48, as shown in FIG. 2. Controller 46 can then use the sensor signal 49 to calculate the piston information using the above-described equations. Alternatively, the sensor signal 49 produced by flow sensor 44 can relate directly to the piston information. Controller 46 is configured to produce a piston information signal (such as piston information output 58 or piston control signal 48).

Controller 46 can be any suitable device including hardware such as an embedded microcontroller, microprocessor, etc.; software; or combinations thereof. Controller 46 is further configured to produce a piston information output, indicated by arrow 58, relating to the piston information. The piston information output 58 can be provided to a human-machine interface 60, such as a display or graphical user interface, to provide the piston information to an operator of the machine to thereby aid in the control of the object being actuated by hydraulic actuator 12.

In another embodiment of the invention, controller 46 is adapted to receive a reference signal 64 from an input device 62, as shown in FIG. 2. Reference signal 64 generally relates to a position, velocity, acceleration and/or direction of movement of piston 12 that is desired by for example an operator of the machine. Input device 62 can be a steering device, a switch, a microcomputer, or other type of input device that could provide a reference signal 64. Controller 46 is adapted to compare the reference signal 64 to the sensor signal 68. This comparison provides controller 46 with information relating to an adjustment that must be made to the hydraulic fluid flow to reach the desired position, velocity, acceleration and/or direction of movement indicated by the reference signal 64. Controller 46 generates a control signal 66 that relates to the required adjustment of piston 12. The control signal 66 can be provided to a valve actuator 50 of hydraulic control valve 13 over communication link 52. Valve actuator 50 actuates hydraulic control valve 13 in response to control signal 66 to adjust the hydraulic fluid flow to produce the desired adjustment of the position, velocity, acceleration and/or direction of movement of piston 12. Those skilled in the art will recognize that controller 46 can be disposed at various locations. Moreover, controller 46 may be a stand-alone component or may be part of flow sensor 44 or even part of control valve 13.

Communication links 48 and 52 can be a physical communication link, such as wires or a data bus, or a wireless communication link. Communication links 48 and 52 can be configured in accordance with a standard 4–20 mA analog signal or a digital signal in accordance with a digital communication protocol such as FOUNDATION™ fieldbus, Controller Area Network (CAN), profibus, or a combination of analog and digital signals, such as with the Highway Addressable Remote Transducer (HART®). In addition, communication links 48 and 52 can provide power to flow sensor 44 and hydraulic control valve 13, respectively. Although FIG. 2 shows separate communication links 48 and 52 for each flow sensor 44A–C and hydraulic control valve 13A–C, a single data bus can be used to interconnect the multiple components of hydraulic control system 42.

Figure 3:
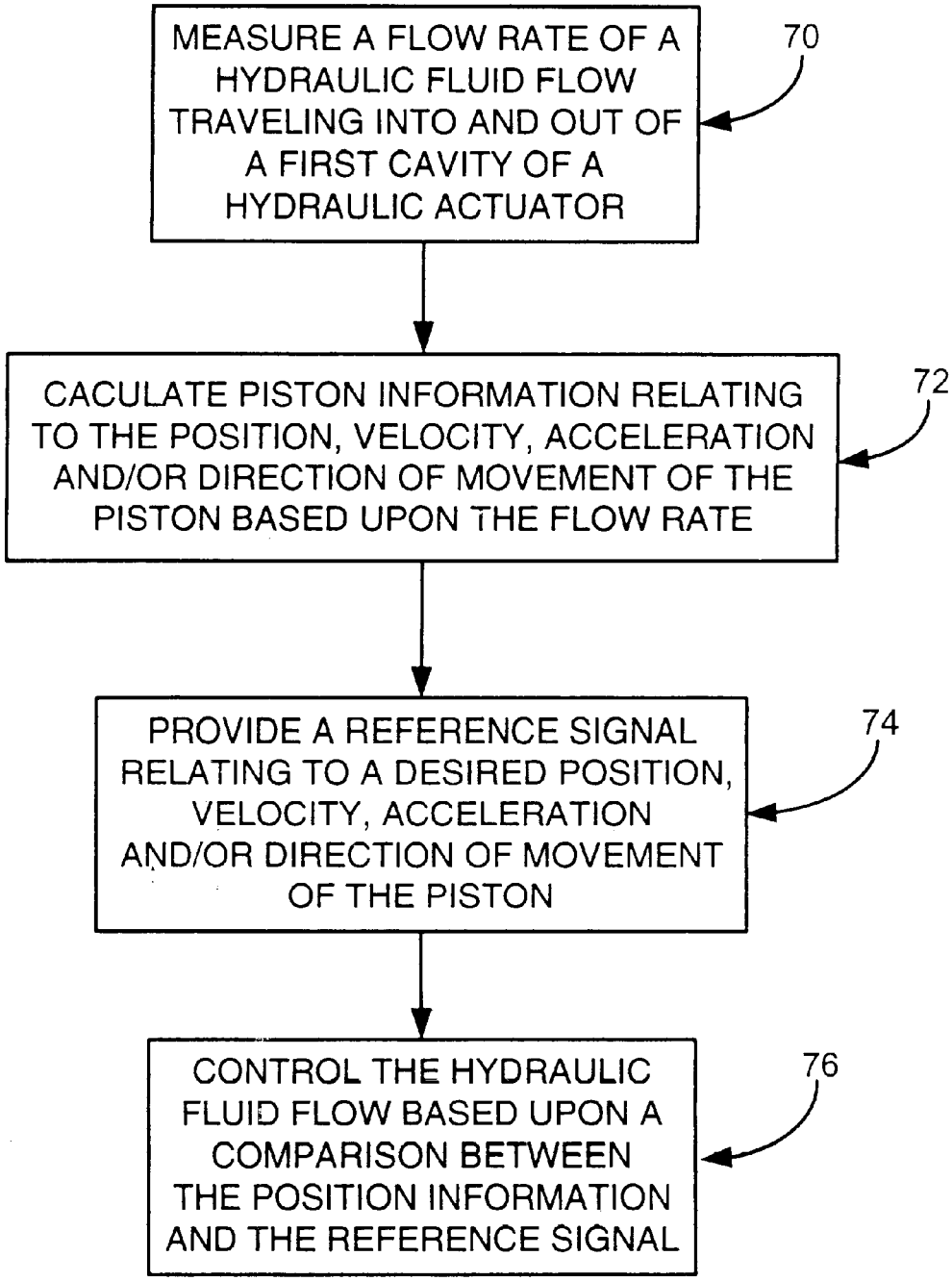
FIG. 3 is a flowchart illustrating a method of controlling at least one hydraulic actuator in accordance with an embodiment of the invention.

The present invention is also directed to a method of controlling at least one hydraulic actuator 12. The method is illustrated in the flowchart of FIG. 3. At step 70, a flow rate $Q_{v1}$ of a hydraulic fluid flow traveling into and out of a first cavity 30 of the hydraulic actuator 12 is measured. Next, at step 72, piston information relating to the position, velocity, acceleration and/or direction of movement of piston 12 is calculated based upon the flow rate $Q_{v1}$. At step 74, a reference signal 64 is provided that relates to a desired position, velocity, acceleration and/or direction of movement of piston 12. Finally, at step 76, the hydraulic fluid flow is adjusted based upon a comparison between the position information and the reference signal. This can be accomplished by providing a control signal to valve actuator 50, as discussed above.

Although the present invention has been described with reference to preferred embodiments, workers skilled in the art will recognize that changes may be made in form and detail without departing from the spirit and scope of the invention.

What is claimed is:

1. A hydraulic control system comprising:

a hydraulic actuator including a piston contained in a hydraulic cylinder;

a fluid flow sensor having a sensor signal relating to a differential pressure across a discontinuity within a hydraulic fluid flow traveling into a cavity of the hydraulic actuator defined by the piston and the hydraulic cylinder;

a controller configured to calculate piston information and produce a control signal in response to a comparison of the piston information to a reference.

2. The hydraulic control system of claim 1, including a communication link between the controller and the fluid flow sensor that provides power to the fluid flow sensor.

3. The hydraulic control system of claim 2, wherein the communication link is selected from a group consisting of a two-wire (4–20 mA) data bus, and a data bus.

4. The hydraulic control system of claim 2, wherein the communication link is configured in accordance with a communication standard selected from a group consisting of a digital communication standard, an analog communication standard, FOUNDATION™ fieldbus, Controller Area Network (CAN), profibus, and Highway Addressable Remote Transducer (HART®).

5. The hydraulic control system of claim 1, including a human-machine interface coupled to the controller and adapted to receive the piston information.

6. The hydraulic control system of claim 1, including a hydraulic control valve adapted to control the hydraulic fluid flow in response to the control signal.

7. The hydraulic control system of claim 6, including a communication link between the hydraulic control valve and the controller, over which the control signal is transmitted.

8. The hydraulic control system of claim 7, wherein the communication link is selected from a group consisting of a physical communication link, and a wireless communication link.

9. The hydraulic control system of claim 7, wherein the communication link is a data bus that is configured in accordance with a communication standard selected from a group consisting of a digital communication standard, an analog communication standard, FOUNDATION™ fieldbus, Controller Area Network (CAN), profibus, and Highway Addressable Remote Transducer (HART®).

10. The system of claim 1, wherein the piston information includes a position of the piston relative to the hydraulic cylinder and the reference is indicative of a desired position of the piston.

11. The system of claim 1, wherein the piston information includes a velocity of the piston relative to the hydraulic cylinder and the reference is indicative of a desired velocity of the piston.

12. The system of claim 1, wherein the piston information includes an acceleration of the piston relative to the hydraulic cylinder and the reference is indicative of a desired acceleration of the piston.

13. The system of claim 1, wherein the piston information includes a direction the piston is traveling relative to the hydraulic cylinder and the reference is indicative of a desired direction of travel for the piston.

14. The system of claim 1, wherein the reference is produced by an input device.

15. A hydraulic control system comprising:

a hydraulic actuator including a piston contained in a hydraulic cylinder;

a fluid flow sensor having a sensor signal relating to a differential pressure across a discontinuity within a hydraulic fluid flow traveling into a cavity of the hydraulic actuator defined by the piston and the hydraulic cylinder;

a reference signal relating to at least one of a desired piston position, velocity, acceleration, and direction of movement;

a controller configured to calculate piston information selected from a group consisting of at least one of a position, a velocity, an acceleration, and a direction of movement of the piston relative to the hydraulic cylinder and produce a control signal based upon a comparison of the piston information to the reference signal; and a hydraulic control valve adapted to control the hydraulic fluid flow in response to the control signal.

16. The hydraulic control system of claim 15, including:

a first communication link between the controller and the flow sensor, over which the sensor signal is provided; and a second communication link between the controller and the hydraulic control valve, over which the control signal is provided;

wherein the first and second communication links are selected from a group consisting of a physical link that supplies power, a data bus, a two-wire data bus, and a wireless communication link.

17. The hydraulic control system of claim 16, wherein the communication link is configured in accordance with a communication standard selected from a group consisting of a digital communication standard, an analog communication standard, FOUNDATION™ fieldbus, Controller Area Network (CAN), profibus, and Highway Addressable Remote Transducer (HART®).

18. A hydraulic control system comprising:

a plurality of hydraulic actuators each including a piston contained in a hydraulic cylinder;

a plurality of fluid flow sensors each having a sensor signal relating to a differential pressure across a discontinuity within a hydraulic fluid flow traveling into a cavity of one of the hydraulic actuators defined by the piston and the hydraulic cylinder;

a controller configured to calculate piston information selected from a group consisting of at least one of a position, a velocity, an acceleration, and a direction of movement of the piston relative to the hydraulic cylinder for each hydraulic actuator, and produce a control signal based upon a comparison of the piston information to a reference signal; and at least one hydraulic control valve configured to control the hydraulic fluid flow in response to the control signal.

19. A method of controlling at least one hydraulic actuator having a piston, comprising steps of:

measuring a differential pressure across a discontinuity placed in a hydraulic fluid flow traveling into and out of a cavity of the hydraulic actuator defined by the piston and a hydraulic cylinder;

calculating piston information selected from at least one of a position, a velocity, an acceleration, and a direction of movement of the piston, based upon the differential pressure;

providing a reference signal relating to at least one of a desired position, velocity, acceleration, and direction of movement of the piston;

controlling the hydraulic fluid flow based upon a comparison between the piston information and the reference signal.

20. The method of claim 19, wherein the controlling step includes:

generating a control signal based upon the comparison between the piston information and the reference signal; and adjusting the hydraulic fluid flow in response to the control signal to provide desired actuation of the piston.

* * * * *